US007284344B2

(12) United States Patent
Pawlus et al.

(10) Patent No.: US 7,284,344 B2
(45) Date of Patent: Oct. 23, 2007

(54) MODULAR SHOE

(75) Inventors: Christopher J. Pawlus, Andover, MA (US); Alexander Dardinski, Newburyport, MA (US); David L. Vattes, Londonderry, NH (US); Douglas E. Clark, Durham, NH (US); Lee Schuttee, Kittery Point, ME (US); John Healy, Madbury, NH (US)

(73) Assignee: The Timberland Company, Stratham, NH (US)

( * ) Notice: Subject to any disclaimer, the term of this patent is extended or adjusted under 35 U.S.C. 154(b) by 0 days.

(21) Appl. No.: 11/368,768

(22) Filed: Mar. 6, 2006

(65) Prior Publication Data

US 2006/0156587 A1 Jul. 20, 2006

Related U.S. Application Data

(63) Continuation of application No. 10/844,302, filed on May 12, 2004, now Pat. No. 7,010,872.

(60) Provisional application No. 60/471,418, filed on May 16, 2003.

(51) Int. Cl.
*A43B 3/24* (2006.01)

(52) U.S. Cl. ..... 36/100; 36/15; 36/101

(58) Field of Classification Search ..... 36/100, 36/101, 15

See application file for complete search history.

(56) References Cited

U.S. PATENT DOCUMENTS 997,657 A 7/1911 Drake
3,014,288 A * 12/1961 Evans et al. ..... 36/1
3,097,438 A * 7/1963 Evans ..... 36/1
3,798,802 A * 3/1974 Sauders ..... 36/138
3,810,318 A 5/1974 Epstein
4,398,357 A 8/1983 Batra
4,733,483 A 3/1988 Lin
4,825,565 A 5/1989 Bigolin
5,086,576 A 2/1992 Lamson
5,325,541 A 7/1994 Willard
5,533,280 A * 7/1996 Halliday ..... 36/101
5,595,005 A 1/1997 Throneburg et al.
5,855,079 A 1/1999 Herbert et al.
6,023,859 A * 2/2000 Burke et al. ..... 36/105
6,298,583 B1 * 10/2001 Allen ..... 36/100
6,954,998 B1 * 10/2005 Lussier ..... 36/107
2003/0200679 A1 * 10/2003 Wilson et al. ..... 36/55
2004/0128863 A1 7/2004 Hong et al.
2004/0194351 A1 * 10/2004 Gallegos ..... 36/140

FOREIGN PATENT DOCUMENTS

JP 08131201 5/1996
WO WO-0133987 5/2001

* cited by examiner

*Primary Examiner*—Ted Kavanaugh
(74) *Attorney, Agent, or Firm*—Lerner, David, Littenberg, Krumholz & Mentlik, LLP

(57) ABSTRACT

A modular shoe separates into components. The components may be interchangeable to provide versatility without requiring a large number of single use shoes. Each shoe component may also be collapsible to provide for convenient packing in a travel bag or other location where space is limited.

20 Claims, 5 Drawing Sheets

MODULAR SHOE

CROSS-REFERENCE TO RELATED APPLICATION

The present application is a continuation of U.S. patent application Ser. No. 10/844,302, filed May 12, 2004 now U.S. Pat. No. 7,010,872, which application claims the benefit of the filing date of U.S. Provisional Application No. 60/471,418, filed on May 16, 2003, the entire disclosures of which are hereby incorporated herein by reference.

BACKGROUND OF THE INVENTION

A pair of shoes is typically adapted for a specific use, with a person owning a number of different types of shoes for different purposes.

For example, different shoes may be used for walking, for hiking, for athletic activities, or for formal occasions. Even within each type of shoe category, a number of pairs of shoes may be required, such as a pair of hiking shoes suitable for snow, a pair for wet terrain, and a lightweight pair designed for greater comfort on long hikes over dry terrain. Similarly, formal footwear may include different colors and styles of shoes for different clothing, and different types of occasions.

The useful variety of available footwear poses particular problems for the traveler, who is frequently faced with the task of packing a variety of gear into one or two bags suitable for carrying. This problem is made worse by the fact that each shoe may be bulky and rigid, requiring significant space in a travel bag, and adding significant weight to the bag once it has been packed.

There remains a need for footwear that offers versatility to travelers in a compact form.

SUMMARY OF THE INVENTION

A modular shoe is provides which separates into components. The components may be interchangeable to provide versatility without requiring a large number of complete shoes. Each subcomponent may also be collapsible to provide for convenient packing in a travel bag or other location where space is limited.

In one embodiment, the shoe of this invention comprises the following components: a foot enclosure for receiving a foot, a chassis adapted to fit beneath the foot enclosure, and a shell surrounding the chassis and foot enclosure for engaging the foot while in use. These components are removable and replaceable to provide a variety of options for the wearer.

In another embodiment, the modular shoe of this invention includes a foot enclosure, a chassis and a shell, wherein the lower surface of the chassis has treads which protrude through one or more openings in the bottom of the shell.

In a further embodiment, the shoe of this invention includes a weatherproof barrier for protecting the foot of the wearer against adverse weather conditions, such as those resulting from rain, water, mud or snow.

In accordance with another embodiment of the present invention, an article of footwear is provided. The article of footwear comprises a shell and a chassis. The shell provides an opening for receiving a foot therein. The shell includes a ground contacting surface on a bottom thereof and a cinching mechanism for securing the foot within the opening. The chassis is adapted for removable insertion within the opening of the shell. The chassis provides a support surface for the foot, a rear surface connected to a heel section of the support surface, and a fold line for collapsing the chassis by folding along the fold line.

In one alternative, the fold line is disposed between the rear surface and the support surface. In another alternative, the rear surface of the chassis includes a protrusion thereon positioned for a facing arrangement with a rear portion of the shell. In this case, the rear surface of the chassis may comprise a rigid back surface that is collapsible along the fold line so that the chassis may be removed from the shell.

In accordance with a further embodiment of the present invention, an article of footwear is provided. The article of footwear includes a chassis and a shell. The chassis provides a support surface for a foot. The chassis including a protrusion thereon. The shell surrounds the chassis, and is adjustable to maintain the chassis in operative engagement with the foot while in use. The shell includes an opening in a heel area thereof. The chassis and the shell are removable and replaceable with respect to one another. The protrusion is suitable for gripping to apply a force to the chassis to disengage the chassis from the shell. The opening in the heel area of the shell is configured to engage with the protrusion on the chassis when the chassis is engaged with the shell.

BRIEF DESCRIPTION OF THE DRAWINGS

The foregoing and other objects and advantages of the invention will be appreciated more fully from the following further description thereof, with reference to the accompanying drawings, wherein.

DETAILED DESCRIPTION

To provide an overall understanding of the invention, certain illustrative embodiments will now be described, including a modular shoe with three components: a foot enclosure, a chassis, and a shell. However, it will be understood that the footwear systems described herein may have utility as a different number of components and subcomponents, such as treads, shell, chassis, and foot enclosure, and may employ components and subcomponents adapted for any number of aesthetic or functional purposes. All such footwear designs are intended to fall within the scope of the systems described herein.

Figure 1:
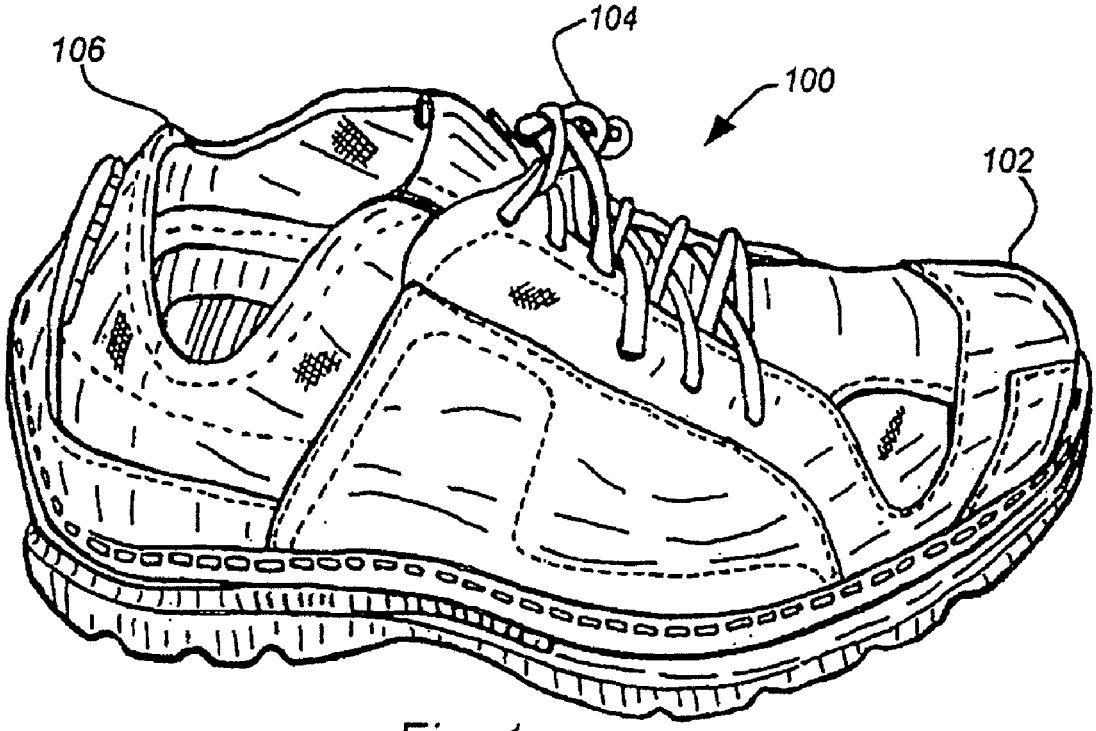
FIG. 1 is a perspective view of a modular shoe.

FIG. 1 depicts a modular shoe. The shoe 100 may include a shell 102 with a cinching mechanism 104, a chassis (not visible), and a foot enclosure 106.

The shell 102 may be formed of conventional shoe materials, such as leather, vinyl, suede, woven material, rubber, or plastic, or combinations of these. The materials for the shell 102 may also be selected according to conventional footwear design constraints including aesthetics, durability, flexibility, or comfort. In general, the shell 102 may be any component providing an exterior surface to the shoe 100 described herein. Thus a number of shells may be carried by a traveler, with each shell serving a particular aesthetic or functional role for the traveler.

The cinching mechanism 104 may be shoe laces, Velcro straps, buckles or any other device or devices for securing the shoe 100 about the foot of a wearer. The cinching mechanism 104 of the shell 102 may be tightened to securely engage the shell 102, the foot enclosure 106, and the chassis about the foot of the wearer while the shoe 100 is in use. The cinching mechanism 104 may be loosened to permit removal and disassembly of the shoe.

The chassis, which will be discussed in further detail below, may provide a supportive bottom surface beneath the foot enclosure 106, such as a rigid, semi-rigid, or flexible support surface, and may include padding along its top surface for the comfort of a wearer of the shoe 100. In general, the chassis may be any component providing rigid support to the overall shoe 100 described herein.

The foot enclosure 106 may be positioned within the shell 102, and is generally adapted to receive a foot of a wearer. In general, the foot enclosure 106 may be any component adapted to receive a wearer's foot. Where the foot enclosure 106 comes directly in contact with the foot, the foot enclosure 106 may have an interior surface comfortable for such direct contact. The foot enclosure 106 may include a padded bottom surface. The foot enclosure 106 may be formed of any suitable material including natural or synthetic woven materials, breathable membranes that are permeable to water vapor but not liquid, and/or an elastic material that stretches to adapt to the shape of a foot. The foot enclosure 106 may also include additional padding or a wear guard directly beneath the cinching mechanism 104 to provide additional comfort at this pressure point within the shoe, and/or to reduce wear on the foot enclosure 106 during repetitive tightening and loosening of the cinching mechanism 104.

Although it is expected that the foot enclosure 106 will remain fixed within the shell 102 when a user's foot is inserted into and removed from the shoe 100, the foot enclosure may further include a zipper (not shown) or other mechanism to facilitate insertion and removal of a foot directly from the enclosure 106 so that the foot enclosure may additionally serve as a slipper apart from the shell 102. In one embodiment, the foot enclosure 106 may be positioned above the chassis. However, it will be appreciated that the foot enclosure 106 may instead enclose the chassis, in which case the chassis would preferably present an upper surface that comfortably engages the foot of the wearer. Further, while the foot enclosure 106 is depicted as a slipper or sock-like component that encloses most of a foot, other types of foot enclosures may be used, such as a strap or band of elastic material, a sandal-like configuration that slides between the toes, around the ankle, or some other portion or portions of the foot, or any other arrangement that operates to hold the foot securely within the shoe 100. All such structures and configurations are intended to fall within the scope of the term "foot enclosure" 106 as that term is used herein, except where specifically described otherwise.

Each of the foot enclosure 106, the chassis, and the shell 102 may be removable and replaceable so that the shoe 100 may be disassembled and reassembled. Or, one of the components may be removed and replaced with a different component. For example, a user may change from a brown shell 102 to a black shell 102 to match a change in clothing. Or the user may change to a chassis with a more aggressive tread before an off-road hike. Or the user may insert a new foot enclosure 106 or chassis after a day's use.

It will be readily appreciated that any number of different or additional components may be included with the shoe 100 described herein, and that the components may be differently arranged. For example, the chassis may be positioned within the foot enclosure 106 rather than between the foot enclosure 106 and the shell 102, with suitable adaptations of padding, surface materials, and attachment mechanisms. All such arrangements are intended to fall within the scope of the footwear described herein.

Figure 2:
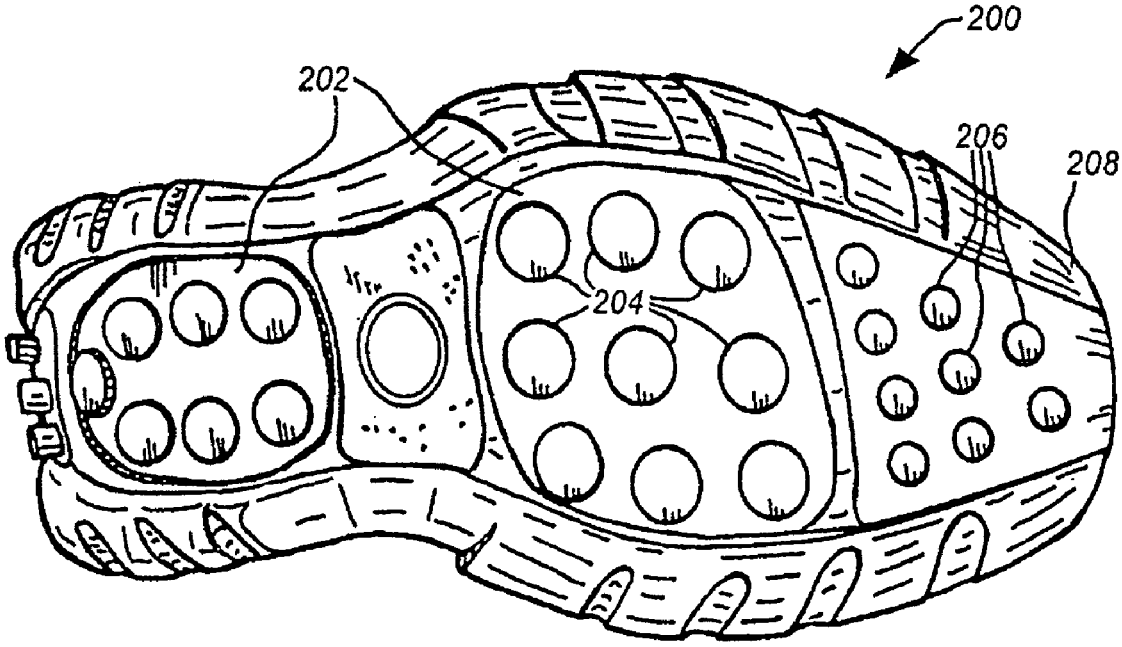
FIG. 2 is a bottom view of a modular shoe.

FIG. 2 is a bottom view of a modular shoe. The shoe 200 may be the shoe 100 described above with reference to FIG. 1. As visible from this perspective of the shoe 200, the chassis 202 may form a portion of a bottom surface of the shoe 200. The shoe 200 may include treads 204 on the chassis 202 and/or treads 206 on the shell 208. The treads 204 may be of various shapes and sizes, with various gripping surfaces according to intended uses of the shoe 200. For example, the treads 204, 206 may be adapted for wet slippery surfaces as in a deck shoe, for comfortable use on dry level surfaces as in a walking shoe, or for traction on off-road terrain as in a hiking shoe. The bottom surfaces of the shell 208 and the chassis 202 may be formed of any conventional material used in a shoe outsole, such as molded rubber or plastic, or any other material suitable for use in a shoe outsole and treads. The chassis 202 may be friction-fit into the shell 208 or otherwise securely but removably affixed to the shell 208, along with a gasket to seal a seam between the chassis 202 and the shell 208 to render the seam watertight.

It will be appreciated that, although not depicted here, in certain embodiments more or less of the surface of the bottom surface of the shoe 200 may be formed from the chassis 202. In certain embodiments, the chassis 202 may not protrude through the shell 208 at all, with the shell 208 forming the entire bottom surface of the shoe 200. However, combining treads 204 with the chassis 202 in an integrated subcomponent permits the nature of the treads 204 to match any interior padding in the chassis 202 so that both the interior cushioning and the treads may be conveniently matched to a particular use of the shoe, such as hiking.

Figure 3:
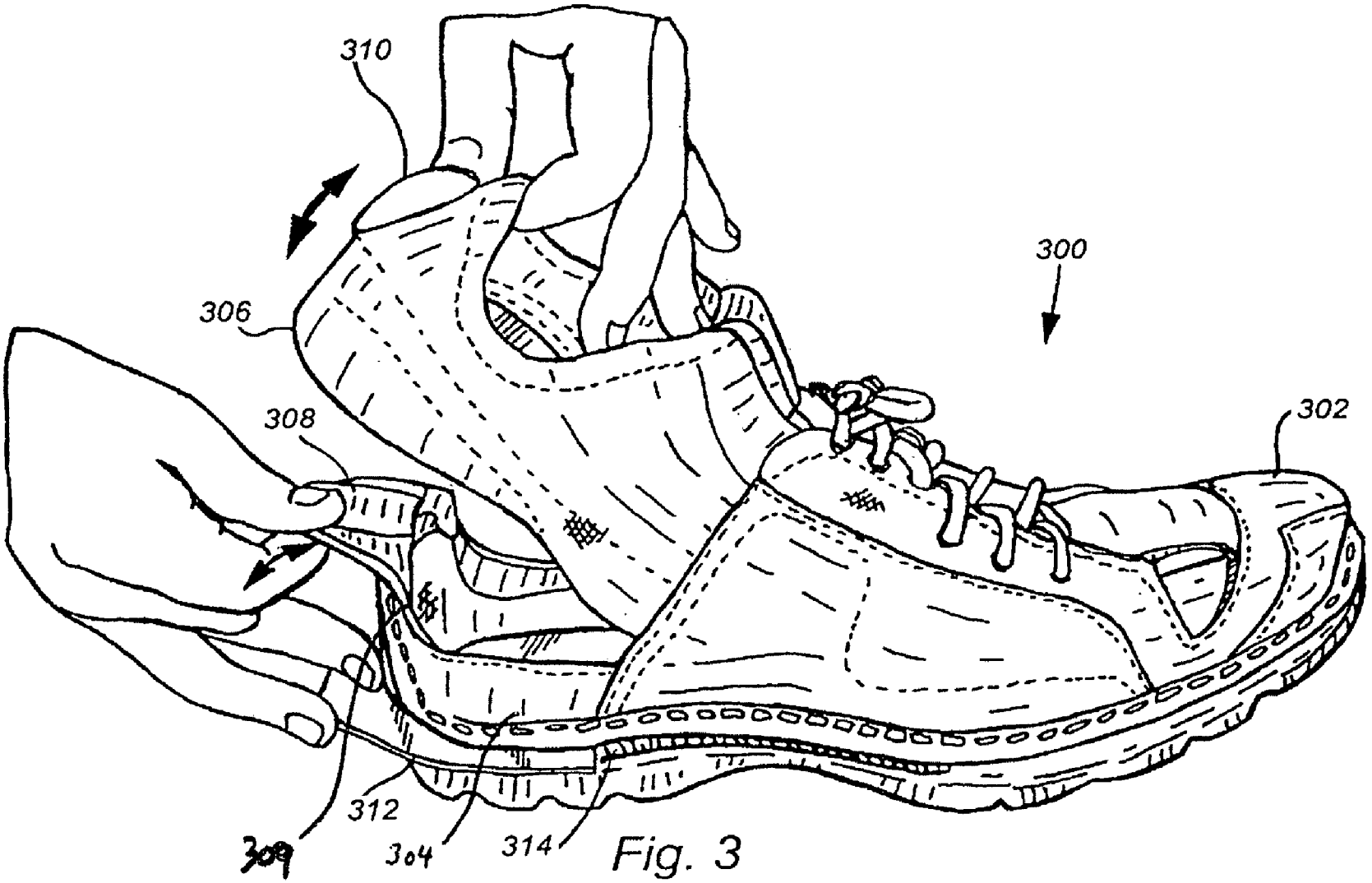
FIG. 3 is a perspective view of modular shoe with a foot enclosure partially disengaged, depicting the disengagement of the shoe by a user.

FIG. 3 depicts a modular shoe with a foot enclosure partially disengaged. The shoe 300 includes a shell 302, a chassis 304, a foot enclosure 306, a first attachment device 308, and a second attachment device 310. A tool 312 that mates with a groove 314 in the shell 302 may be provided to assist with disassembly of the shoe 300. The shoe 300 may be any of the shoes described above.

The first attachment device 308 and the second attachment device 310 may include any mechanism for securing the foot enclosure 306 within the shell 302 and/or the chassis 304. For example, the devices 308, 310 may include mating Velcro strips on the foot enclosure 306 and the shell 302, or a similarly positioned button and button hole, or a button and snap, or other device or mechanism for securing the foot enclosure 306 within the shoe 300. Once the devices 308, 310 have been detached from one another, the foot enclosure 306 may be withdrawn from the shell 302 as depicted. The rear surface of the chassis 304 may fold along fold line 309. When the foot enclosure 306 is inserted into the shell, the devices 308, 310 may be reattached to secure the foot enclosure 306 in place. Although the precise placement and nature of the devices 308, 310 is not essential, it is preferred that the devices 308, 310 are of the same type, and in the same location for different shells and foot enclosures, so that the modular nature of the shoe 300 is maintained.

The tool 312 may provide a surface against which a downward pressure may be conveniently exerted while pulling upward to withdraw the foot enclosure 306 from the shell 302. The tool 312 may be generally U-shaped, and the groove 314 in a heel area of the shell 302 may mate with the tool 312 so that the tool 312 horizontally slides onto and off of the groove 314. Any other tool or technique that provides a suitable surface for applying force counter to withdrawal of the foot enclosure 306 may be similarly employed.

Figure 4:
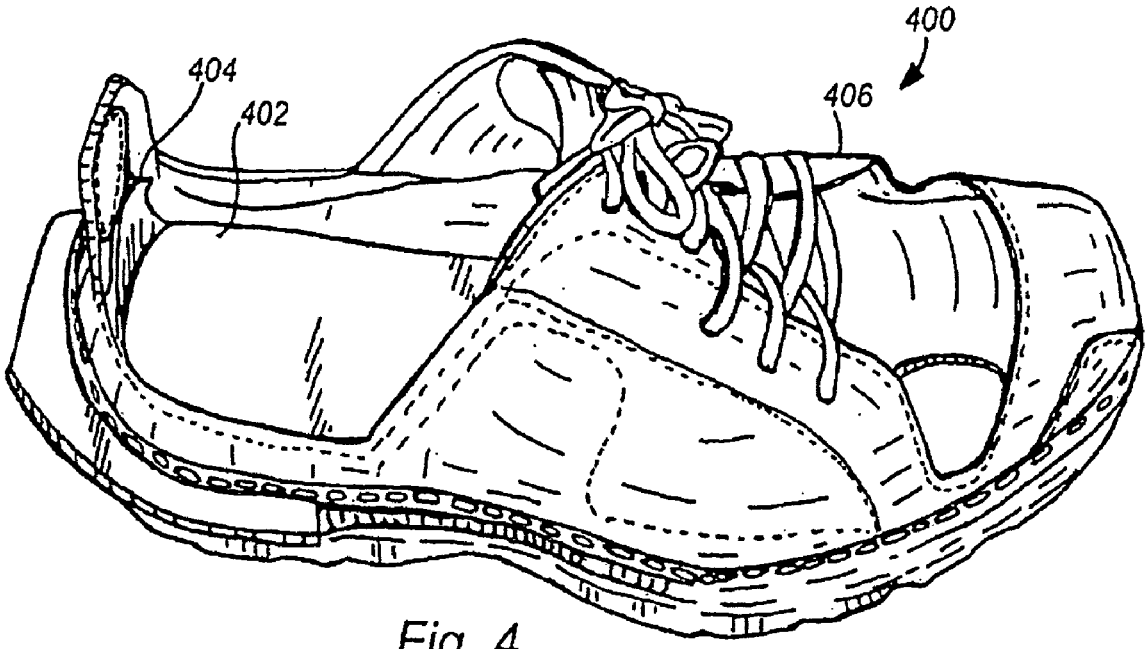
FIG. 4 is a perspective view of a modular shoe without a foot enclosure.

FIG. 4 depicts a modular shoe without a foot enclosure. The shoe 400 may be any of the shoes described above, and may include a chassis 402, a tab 404, and a shell 406. With the foot enclosure (not shown) removed, an upper surface of the chassis 402 is visible. The upper surface of the chassis 402 may be suitably padded, such as by provided extra padding in the heel area to absorb shock during walking. The tab 404 or other protrusion may extend from the chassis 402 in a manner suitable for gripping and pulling to withdraw the chassis 402 from the shell 404. In lieu of a tab 404, the protrusion may include a hook or other mechanical device suitable for gripping and withdrawal with an appropriate tool, although such a mechanical protrusion would preferably be positioned and configured to avoid discomfort to a wearer of the shoe 400.

Figure 5:
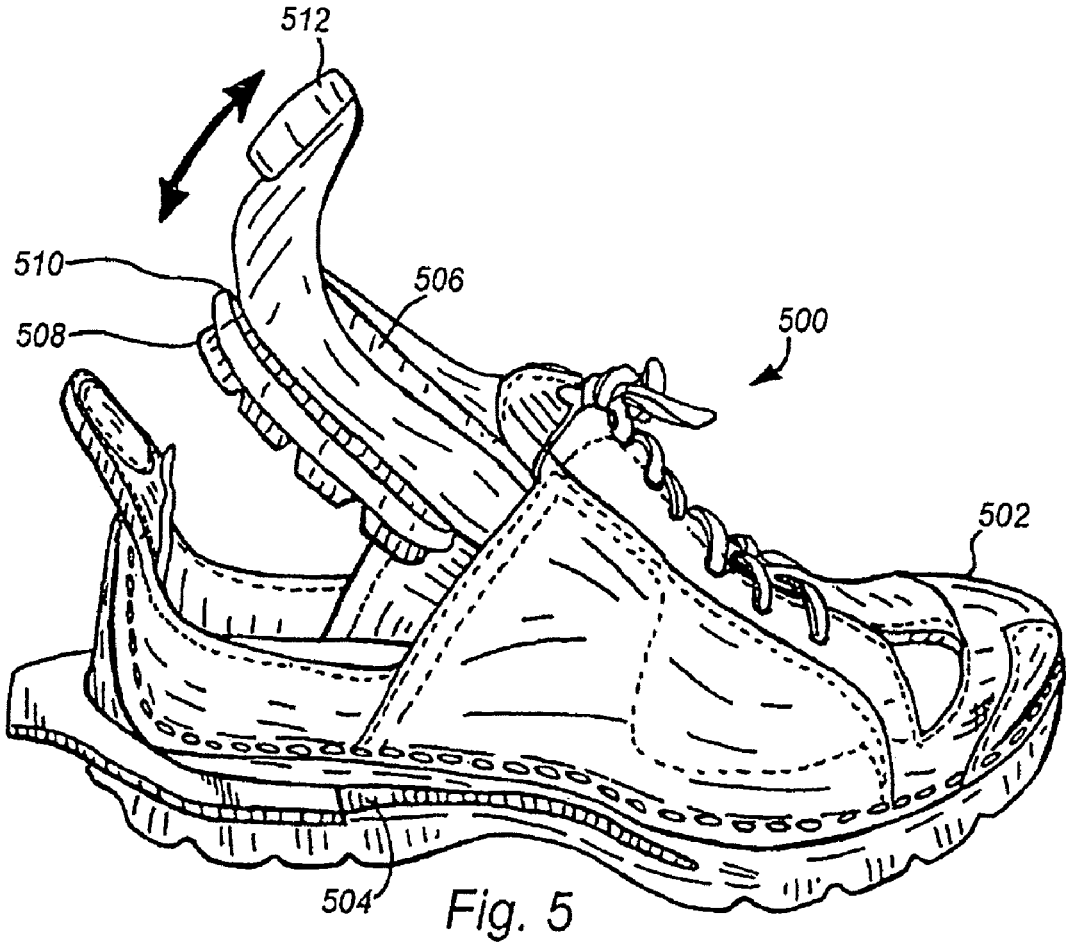
FIG. 5 is a perspective view of a modular shoe with a chassis partially disengaged and depicting disengagement of the chassis.

FIG. 5 depicts a modular shoe with a chassis partially disengaged. The shoe 500 may be any of the shoes described above, and may include a shell 502 with a groove 504 in the heel area and a chassis 506 with treads 508, a gasket 510, and a tab 512. A tool 514, such as the tool 312 described above with reference to FIG. 3, may be provided that mates with the groove 504 to assist with disassembly of the shoe 500.

The treads 508, as noted above, may be configured to protrude through openings (not shown) in the shell 502 to provide a gripping surface while the shoe 500 is in use. As noted above, the tread type may vary according to an expected use for the chassis 508, such as for sporting, outdoor, casual, or formal use. Any suitable padding or cushioning, such as foam or an air or gas bladder (or interconnecting or isolated groups of bladders) may be included in the chassis 506 to cushion areas, such as the heel for the user's foot.

The chassis 506 may also include uniform or varying reinforcements, or layers of stiff material, in order to impart a desired degree of stiffness to the entire chassis 506, and individual areas thereof. For example, a stiff heel area may be desired to distribute the shock across a padded area of the chassis 506 when the heel strikes a surface during walking, whereas a more flexible area may be desired further forward in the shoe where the foot naturally flexes during walking motion.

The gasket 510 may be, for example, a rubber bead attached to the chassis 506 where the chassis 506 mates with the shell 502. The frictional engagement of the chassis 506 to the shell 502 may secure the chassis 506 within the shell 502, and provide a watertight seal to a bottom surface of the shoe 500.

The tab 512 may align and further secure the chassis 506 within the shell 502 by mating with a corresponding slot (not shown) in the shell 502.

Figure 6:
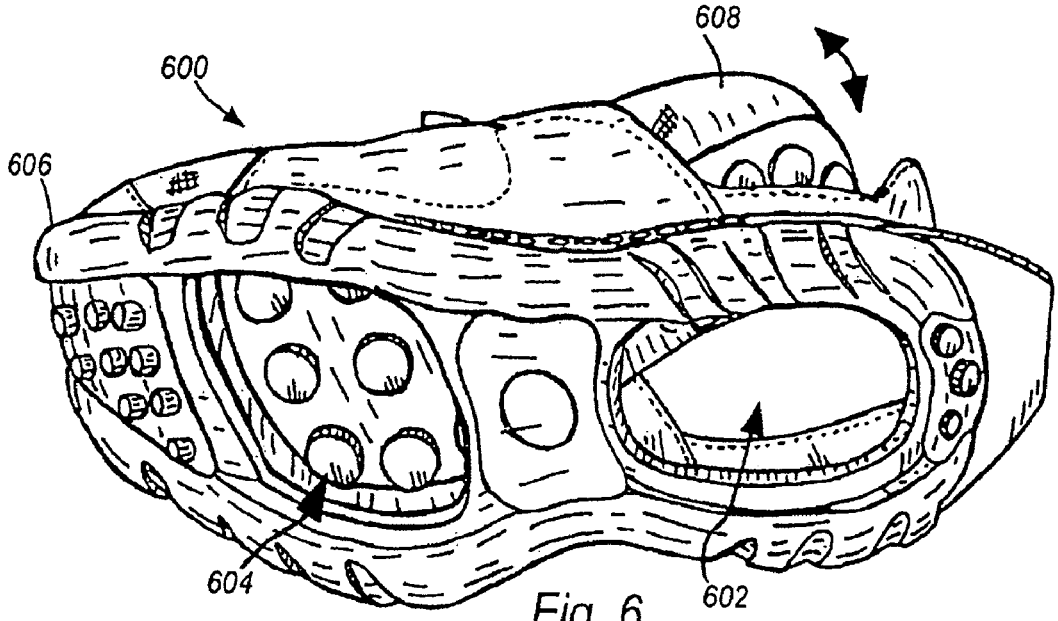
FIG. 6 is a bottom view of a modular shoe with a chassis partially disengaged.

FIG. 6 is a bottom view of a modular shoe with a chassis partially disengaged. The shoe 600 may be any of the shoes described above. From this perspective, two openings 602, 604 are visible in the shell 606, once the chassis 608 has been removed. The openings 602, 604 are configured to receive tread portions of the chassis 608, and include edges that mate with the gasket (not shown) on the chassis 608. It will be appreciated that other arrangements of this construction are possible. For example, more or less openings may be provided in the shell 606, and other securing and sealing mechanisms may be used, such as a gasket on the shell 604 instead of the chassis 608.

Figure 7:
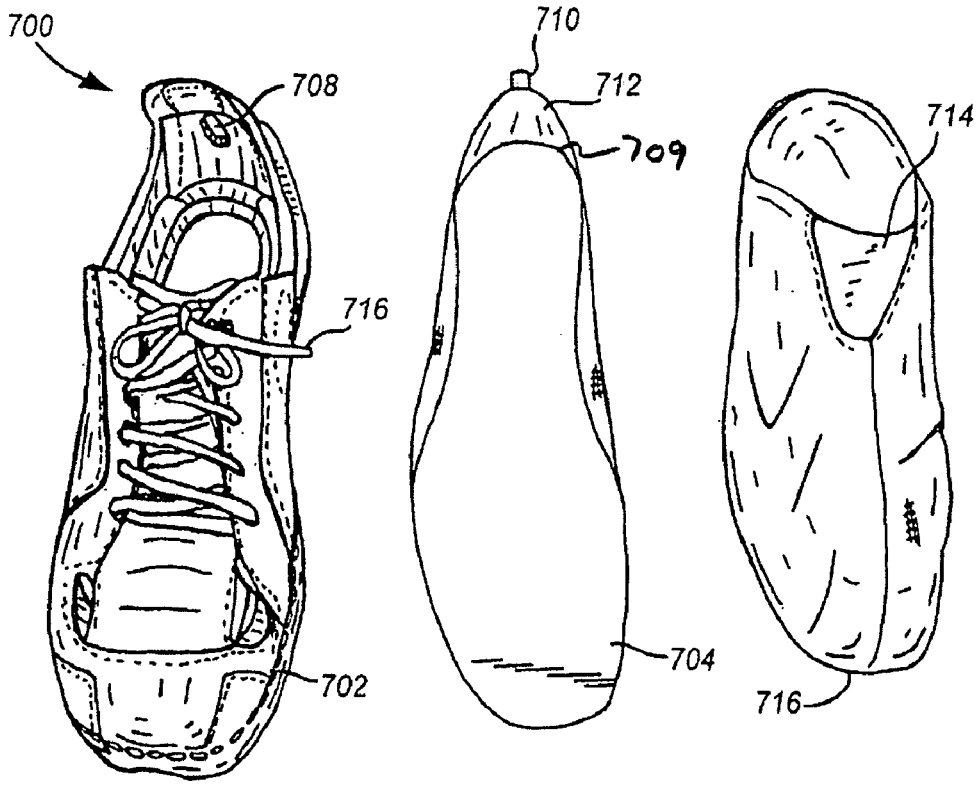
FIG. 7 is a top front view of the components of a modular shoe.

FIG. 7 is a top front view of components of a modular shoe. The shoe 700 may be any of the shoes described above, and may include a shell 702, a chassis 704, and a foot enclosure 706. Certain features of the shoe 700 are now described in more detail.

From this perspective, a slot 708 is visible on the rear surface of the shell 702. A corresponding tab 710 is visible on the chassis 704. In operation, the tab 710 is urged into an interlocking engagement with the slot 708 by a rigid back surface 712 of the chassis 704 when the chassis 704 is inserted into the shell 702. In order to disengage the chassis 704 from the shell 702, the rigid back surface 712 may be pressed toward the front of the shoe 700 so that the tab 710 releases from the slot 708 in the shell 702. The rigid back surface 712 may fold along fold line 709. The heel portion of the chassis 704 may then be drawn upward and out of the shell 702, as described above.

It will also be noted that a reinforced area 714 is provided on the foot enclosure 706. This may prevent chaffing when this region of the foot enclosure 706 is aligned with laces 716 of the shell 702. The reinforced area 714 may be rigid to distribute the pressure exerted by the laces 716 (or other cinching mechanism) against the foot enclosure 706 when the shoe 700 is in use.

Figure 8:
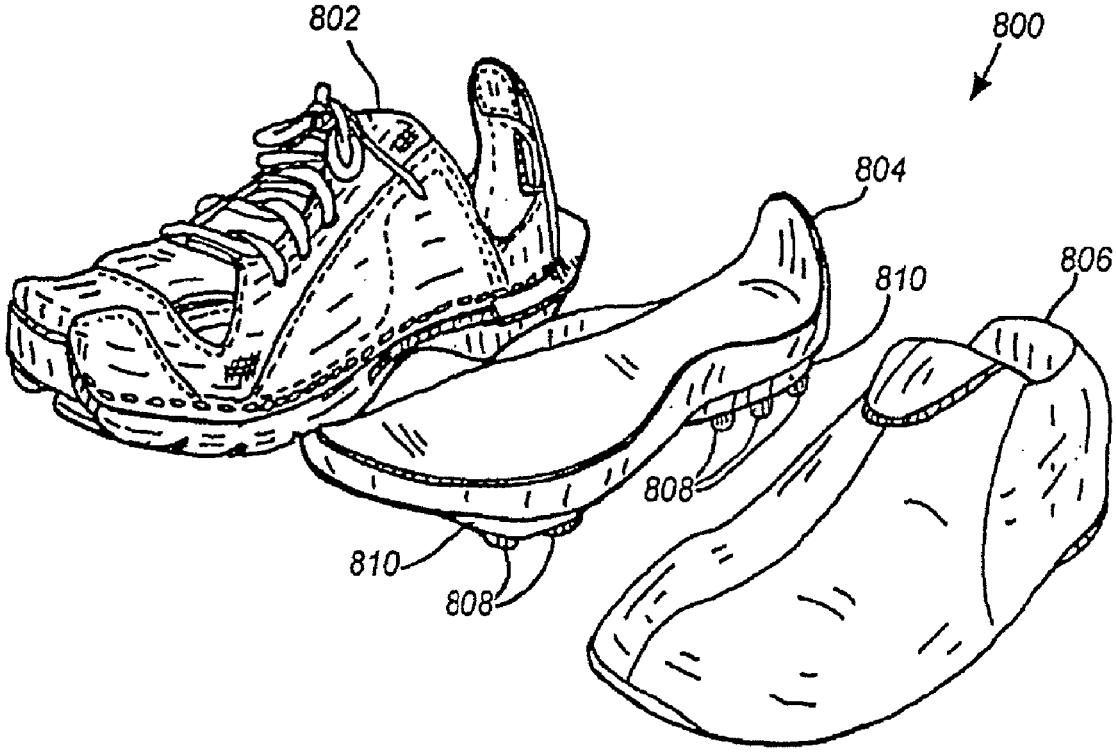
FIG. 8 is a front side view of components of a modular shoe.

FIG. 8 is a front side view of subcomponents of a modular shoe. The shoe 800 may be any of the shoes described above, and may include a shell 802, a chassis 804, and a foot enclosure 806. In addition to many of the features described above, this view illustrates the treads 808 and lower surfaces 810 that protrude from the chassis 804 to fill mating openings in a bottom surface of the shell 802.

Other additions and modifications may be made to the modular shoes described herein that are not depicted in the above drawings. For example, an optional or supplemental layer may be provided to be worn under certain weather conditions. This weatherproof layer may present a barrier to, for example, water, snow, or wind, so that a shoe additionally employing the weatherproof layer is specifically adapted for use in water, snow, or mud, or on surfaces such as ice, or in particular inclement conditions. The weatherproof layer may also be designed for other weather conditions, such as by fashioning the layer of an absorbing or wicking material for use in hot weather. The weatherproof layer may be disposed about the outside of the shell to provide an exterior barrier to such elements or conditions, or the weatherproof layer may be disposed between layers of the shoe, such as between the shell and the chassis, or between the chassis and the foot enclosure, or more generally anywhere between the shell and the foot enclosure of the shoes described above. The weatherproof layer may also be a sock, bootie, or similar sheath that serves as a foot enclosure in place of, or in addition to, the foot enclosures described above.

In certain embodiments, the components of the shoe may be collapsible to permit convenient stowage, such as in a travel bag or other location where space is limited. Non-rigid components may be collapsible in any convenient fashion. Relatively rigid components may include grooves, creases, or hinges to permit folding along certain lines into a more compact geometry suitable for packing or other stowage. Any one or more of the components may be collapsible in this fashion.

In various embodiments, the modular shoe described herein may provide a number of advantages over existing shoes. The modular shoe may be compact and lightweight, while providing the functional and stylistic variety of a number of different shoe types and colors. The relatively low weight and small size, when compared to numerous pairs of shoes that might otherwise be required or desired, may provide particular advantage to a traveler with limited luggage space for footwear. Furthermore, the shoe may be separated into components that may be more easily cleaned and dried, and components such as the foot enclosure or chassis may be refreshed and replaced conveniently to avoid wearing the same footwear over a number of days.

In certain embodiments, some or all of the components of the shoe may be washable to permit cleaning of shoes in a sink or, if machine washable, with other laundry. To this end, some or all of the components may be made of washable materials that can be cleansed with water and soap or other detergents or cleaning agents. Such materials may include a washable leather or any of a number of synthetic materials. The material(s) may be hydrophobic to facilitate drying and relatively quick reuse.

While the invention has been disclosed in connection with the preferred embodiments shown and described in detail, it will be understood that the invention is not to be limited to the embodiments disclosed herein, but is to be understood from the following claims, which are to be interpreted as broadly as allowed under the law.

The invention claimed is:

1. A shoe, comprising:

a foot enclosure adapted to receive a foot, the foot enclosure having an interior surface suitable for remaining in contact with a foot;

a chassis adapted to fit beneath the foot enclosure, the chassis providing a support surface for the foot; and a shell surrounding the chassis and the foot enclosure, the shell being adjustable to maintain the foot enclosure and the chassis in operative engagement with the foot while in use;

wherein each of the foot enclosure, the chassis, and the shell are removable and replaceable with respect to one another;

wherein at least one of the chassis, the foot enclosure, and the shell is collapsible; and wherein at least the chassis includes a fold line for collapsing the chassis by folding along the fold line.

2. The shoe of claim 1 wherein the foot enclosure includes a vapor-permeable, liquid-impermeable membrane.

3. The shoe of claim 1 wherein the foot enclosure includes a reinforcement along a top surface thereof, the reinforcement corresponding to a location of laces in the shell.

4. The shoe of claim 1 wherein the chassis includes a lower surface having treads configured to protrude through one or more openings in the shell while the shoe is in use.

5. The shoe of claim 1 wherein the chassis includes a gasket for engaging, in a watertight fashion, one or more openings in the shell.

6. The shoe of claim 1 wherein the shell includes one or more openings configured to receive treads on the chassis.

7. The shoe of claim 1 wherein the shell includes at cinching mechanism for securing the foot enclosure, the chassis, and the shell to the foot.

8. The shoe of claim 1 wherein the cinching mechanism includes at least one of laces or hook and loop fasteners.

9. The shoe of claim 1 further comprising a weatherproof layer presenting a barrier to at least one of water or snow.

10. The shoe of claim 1 wherein the foot enclosure is the weatherproof layer.

11. The shoe of claim 1 wherein the weatherproof layer encloses the shell to provide a weatherproof exterior layer.

12. The shoe of claim 1 wherein the weatherproof layer is positioned between the shell and the foot enclosure.

13. The shoe of claim 1 further comprising a tool for disassembling the shell, the chassis, and the foot enclosure, the tool removably and replaceably engaging with the shell in a heel area of the shell and, when engaged with the heel area, providing a surface for applying a downward force to the heel area while an upward force is applied to at least one of the chassis or the foot enclosure.

14. The shoe of claim 1 further comprising a protrusion on the chassis, the protrusion suitable for gripping to apply a force to the chassis to disengage the chassis from the shell.

15. The shoe of claim 1 further comprising a tool for gripping the protrusion.

16. An article of footwear, comprising:

a shell providing an opening for receiving a foot therein, the shell including a ground contacting surface on a bottom thereof and a cinching mechanism for securing the foot within the opening; and a chassis adapted for removable insertion within the opening of the shell, the chassis providing a support surface for the foot, a rear surface connected to a heel section of the support surface, and a fold line comprising a groove for collapsing the chassis by folding along the fold line.

17. The article of footwear of claim 16, wherein the fold line is disposed between the rear surface and the support surface.

18. The article of footwear of claim 16, wherein the rear surface of the chassis includes a protrusion thereon positioned for a facing arrangement with a rear portion of the shell.

19. The article of footwear of claim 18, wherein the rear surface of the chassis comprises a rigid back surface that is collapsible along the fold line so that the chassis may be removed from the shell.

20. A shoe, comprising:

a foot enclosure adapted to receive a foot, the foot enclosure having an interior surface suitable for remaining in contact with a foot;

a chassis adapted to fit beneath the foot enclosure, the chassis providing a support surface for the foot; and a shell surrounding the chassis and the foot enclosure, the shell being adjustable to maintain the foot enclosure and the chassis in operative engagement with the foot while in use;

wherein each of the foot enclosure, the chassis, and the shell are removable and replaceable with respect to one another;

wherein at least one of the chassis, the foot enclosure, and the shell is collapsible;

wherein at least the chassis includes a fold line for collapsing the chassis by folding along the fold line; and wherein the fold line is a groove or a hinge operable to permit folding of the chassis into a compact geometry suitable for packing.

* * * * *

UNITED STATES PATENT AND TRADEMARK OFFICE

CERTIFICATE OF CORRECTION

PATENT NO. : 7,284,344 B2
APPLICATION NO. : 11/368768
DATED : October 23, 2007
INVENTOR(S) : Christopher J. Pawlus et al.

It is certified that error appears in the above-identified patent and that said Letters Patent is hereby corrected as shown below:

Column 1, line 39, “provides” should read -- provided --.

Column 2, line 14, “including” should read -- includes --.

Column 2, line 33, after “of”, insert -- a --.

Column 4, line 64, after “310”, change “is” to -- are --.

Column 5, line 15, “provided” should read -- providing --.

Column 7, Claim 1, line 41, after “shell” change “are” to -- is --.

Column 7, Claim 7, line 60, after “includes” change “at” to -- a --.

Column 8, Claim 20, line 55, after “shell” change “are” to -- is --.

Signed and Sealed this

Fourth Day of November, 2008

JON W. DUDAS
*Director of the United States Patent and Trademark Office*